United States Patent [19]

Hosoi

[11] 4,332,109

[45] Jun. 1, 1982

[54] GRINDING APPARATUS FOR A FLANK OF AN END MILL POINT

[76] Inventor: Toshiaki Hosoi, 9-10-5, Kamiminami, Hirano-ku, Osaka, 546, Japan

[21] Appl. No.: 196,045

[22] PCT Filed: Jul. 27, 1979

[86] PCT No.: PCT/JP79/00198

§ 371 Date: Apr. 4, 1980

§ 102(e) Date: Jan. 16, 1980

[87] PCT Pub. No.: WO80/00323

PCT Pub. Date: Mar. 6, 1980

[30] Foreign Application Priority Data

Aug. 4, 1978 [JP] Japan ..... 53/95753

[51] Int. Cl.[3] ..... B24B 19/00

[52] U.S. Cl. ..... 51/127; 51/225

[58] Field of Search ..... 51/100, 127, 267, 225

[56] References Cited

U.S. PATENT DOCUMENTS

| | | | |
|---|---|---|---|
| 2,470,021 | 5/1949 | D'Avaucourt | 51/100 R |
| 2,538,532 | 1/1951 | Oliver | 51/267 X |
| 2,552,645 | 5/1951 | Oliver | 51/267 X |
| 3,568,369 | 3/1971 | Marshall | 51/127 X |

*Primary Examiner*—Harold D. Whitehead

*Attorney, Agent, or Firm*—Koda and Androlia

[57] ABSTRACT

This invention relates to an apparatus for grinding the cutting edge flank having special figure of an end mill. This apparatus comprises a grinding part (30) having a grinding wheel (31), a model guide (61) having a guide face (61*a*) flush with the grinding face of the grinding wheel (31) and arranged to locate under, a cutter support (40), a model support (50) for supporting a model ($B_1$) parallel with the axial line of the cutter (A) and a shift part (70) for shifting the both support (40), (50) together toward the grinding wheel (31) and the model guide (61). The model ($B_1$) has the same outer periphery surface as rotary contour outline of the cutter and is provided with a groove (C) so that there is formed a model line ($C_1$) corresponding to the required cutting edge of the cutter. The cutting edge flank (24) is grinded easily and accurately in imitation of the model ($B_1$), by turning the cutter and the model solidly in contacting the model ($B_1$) with the guide face (61*a*) at the model line ($C_1$) and contacting the cutter (A) with the grinding face (31*a*).

1 Claim, 20 Drawing Figures

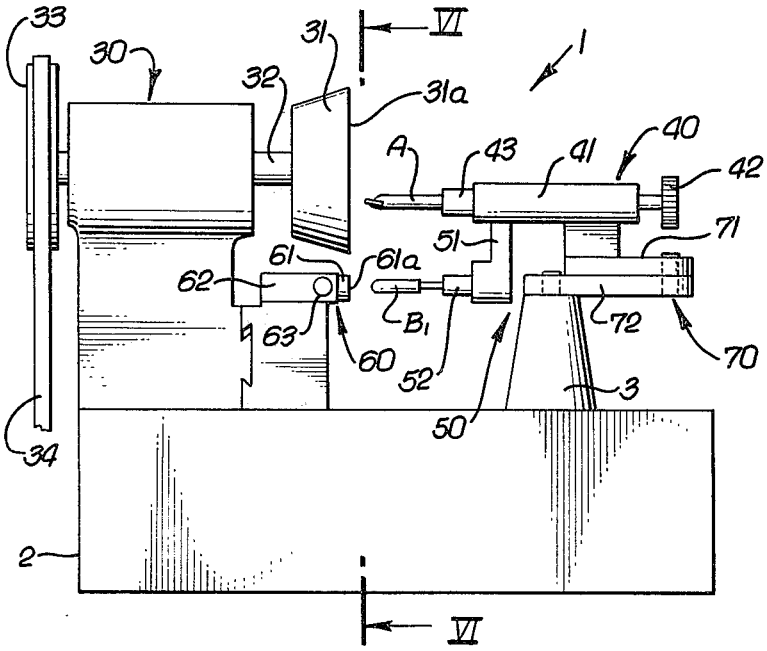
Fig. 4.
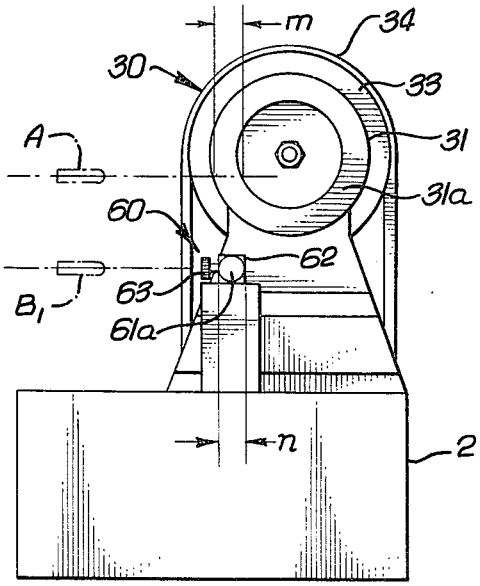
Fig. 6.
Fig. 5.
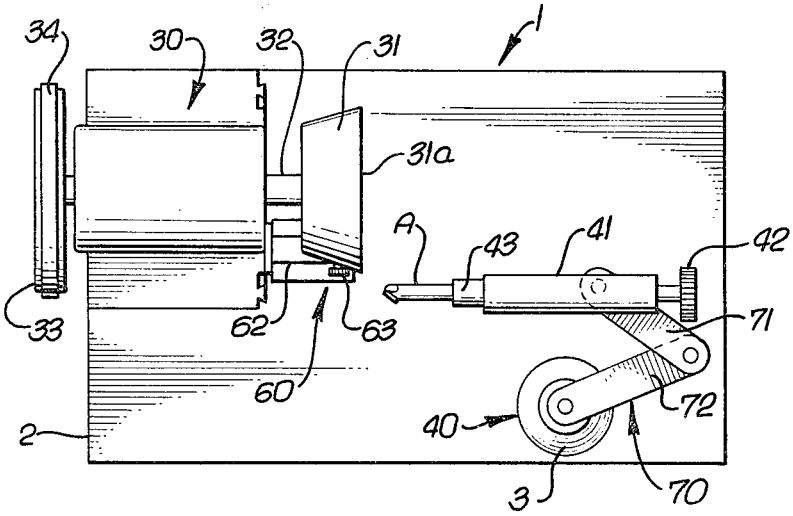

GRINDING APPARATUS FOR A FLANK OF AN END MILL POINT

TECHNICAL FIELD

This invention relates to an apparatus for grinding the cutting edge flank having special figure of a newly developed end mill, which was developed by this inventor.

BACKGROUND ART

First, the essential point of this newly developed end mill A will be described. Referring to FIGS. 1 to 3 inclusive, an end mill body 10 is comprised of a shank 11 and a spherical point 12, where a tip 20 is fixed. The tip forms substantially rectangular plate, a substantially lengthwise long rectangle with inclination rake angle E in front view (FIG. 1), and a substantially lengthwise long rectangle in bottom view (FIG. 2). And the tip 20 forms a curve composed of a circular arc with radius Q at center P and a straight line, in a left side view (in FIG. 1) as shown in FIG. 3. The positional relation of the tip 20 and the body point 12 in bottom view, will be as follows. A first long side face 21 is located on the radius of the end mill, a corner 26 is located on near the end mill center O, and a first short side face 23 is positioned on ahead side from the first long side face 21 in a direction of rotation S of the end mill. A second long side face 22 forms a rake face, a second short side face 24 forms a flank of the tip side, and a point curve surface 25 forms a flank of the tip nose. Moreover, the second long side face 22 and the cutting edge formed on the nose of the first short side face 23 are connected by a smooth curve to form the nose cutting edge 27, and a boundary line between the second long side face 22 and the second short side face 24 connected to the cutting edge 27 forms a side cutting edge 28. Namely, the nose cutting edge 27 are shown as a smooth curve or a smooth combined line of a curve and a straight line or a broken line which is convex in the bottom view in ahead side in the direction of rotation of the end mill against the straight line L connecting the beginning of the cutting edge at end mill center and the end of the cutting edge at the outer periphery of the end mill. Consequently, a three dimensional cutting is achieved at the point cutting edge 27, and the cutting force acting on the tip decreases greatly, and the cutter endures satisfactorily a high speed heavy cutting. In case of small end mill, the prescribed cutting edge is directly formed in a round rod of cemented carbide, not formed in a tip.

DISCLOSURE OF THE INVENTION

It is an object of the present invention to provide a grinding apparatus for grinding the point flank of such difficult curved surface as above easily and accurately by an unskilled hand.

These objects are to be achieved by the present invention as below.

A grinding apparatus for a flank of an end mill point comprising:

a grinding part having a grinding wheel;

a model guide having a guide face flush with the grinding face of the grinding wheel and arranged to locate under the grinding face of the grinding wheel;

a cutter support fixing the stickey cutter horizontally in a support shell;

a model support wherein the model is inserted in a cylindrical arm hanging from the support shell of the cutter support is substantially the same height as the model guide, and the axial line of the model is located to be pararell with the axial line of the cutter, and, the model contacts with the model guide when the cutter contacts with the grinding face of the grinding wheel;

a shift part for shifting the cutter support and the model support together toward the grinding wheel;

and the model is of a cylindrical body having a spherical point which has the same outer periphery surface as rotary contour outline of the cutter grinded in the required condition, and on the outer periphery surface of the model a groove is provided so that there is formed a model line corresponding to the required cutting edge of the cutter;

the cutter pre-grinded to have the same surface of revolution as the model is supported in the cutter support for obtaining the required clearance angle;

the model is supported in the model support in the same positional relation as the cutter;

the cutter and the model are turned solidly substantially with a center of the point of the cutter by contacting the model line with the guide face.

BRIEF DESCRIPTION OF THE DRAWINGS

FIG. 4 is an elevational view of an embodiment according to the invention.

FIG. 5 is a plane view thereof.

FIG. 6 is a side view of a main portion of FIG. 4.

BEST MODE FOR CARRYING OUT THE INVENTION

Figure 1:
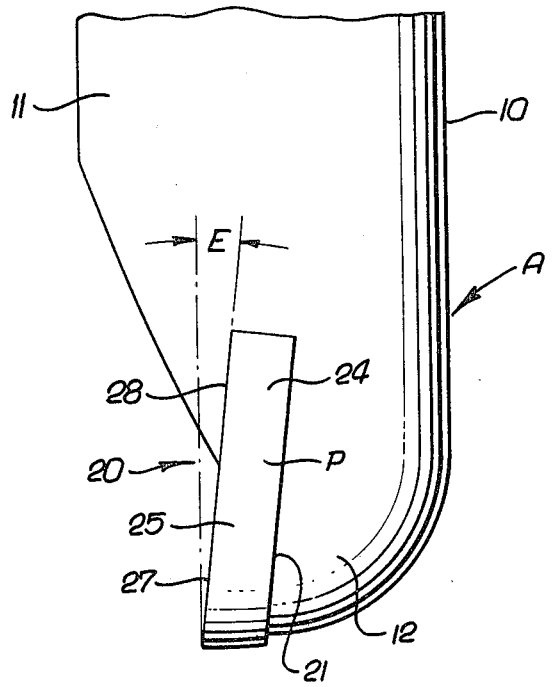
FIG. 1 is an elevational view of an end mill according to an embodiment of the invention.
Figure 3:
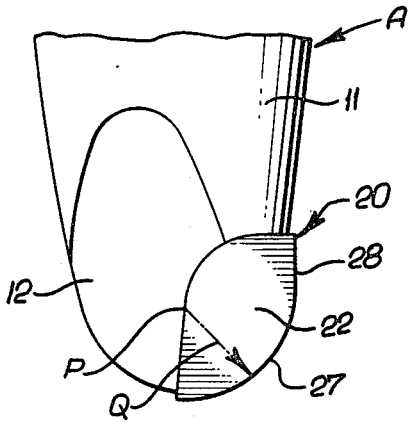
FIG. 3 is a left side view thereof.
Figure 2:
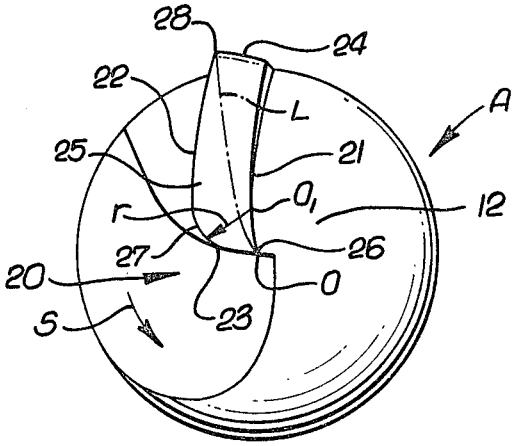
FIG. 2 is a bottom view thereof.
Figure 7:
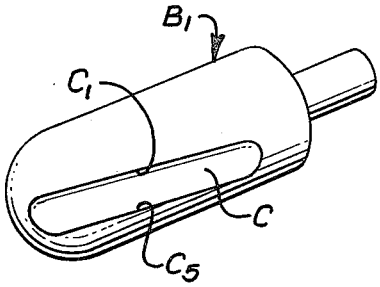
FIG. 7 is an enlarged perspective view of the model.

Referring now to the drawings, one preferred embodiment of the present invention will be described hereinbelow.

In FIGS. 4 to 6 inclusive, this end mill grinding apparatus 1 generally consists of a grinding part 30, a cutter (end mill) support 40, a model support 50, a model guide 60 and a cutter model shifter 70.

Grinding part 30 is supported by a stand 2. A horizontal shaft 32 of a grinding wheel 31 is rotated by a motor (not shown) via a pulley 33. An end surface of the grinding wheel 31 becomes a vertical grinding face 31*a*. Reference numeral 34 shows a belt for operation.

In a support 40 for a cutter (end mill) A, a sleeve 43 is rotatably supported by means of a handle 42 in a horizontal support shell 41, and the cutter A, is inserted and fixed in the sleeve 41 horizontally and concentrically.

In a support 50 for a model B1, a sleeve 52 is inserted in a horizontal cylindrical arm 51 which hangs from the support shell 41, and the model B1 is inserted and fixed in the sleeve 52 concentrically.

Therefore, an axis shaftline of the cutter A, the cutter support shell 41 and the sleeve 43 and an axis shaftline of the model cylindrical arm 51, sleeve 52 and the model B1 are located in a same vertical plane.

In the model guide part 60, a cylindrical block model guide 61 is inserted and fixed in a support member 62. The model guide 61 has a horizontal axis shaftline substantially pararell to the shaft 32 of the grinding wheel and formed with a guide surface 61*a* in a same vertical plane as the grinding face 31*a* of the wheel 31. The model guide 61 is movable in an axial direction, and tighten with a screw 63. Consequently, this model guide 61 can be retreated according to an abrasion of the grinding face 31*a* of the wheel 31 and to a compensation value of a tracer stylus against the cutter.

In the cutter model shifter 70, the support shell 41 is connected and supported on the base 3 by means of two pin jointed links 71, 72. Consequently, the support shell 41 is capable of a rectilinear motion, translation and rotation in a horizontal plane toward the grinding wheel 31.

Here the most peculiar point of the invention lies in a figure of the model B1.

The model B1 is of a cylindrical body having a spherical point which has the same outer periphery surface as rotary contour outline of the cutter grinded in the required condition, as shown in FIGS. 7 to 11. On the outer periphery surface of the model B1, U-shape groove C having mutually pararell two side walls C2, C3 and cylindrical bottom wall C4 is provided so that there is formed a model line C1 corresponding to the required cutting edge of the cutter.

Figure 8:
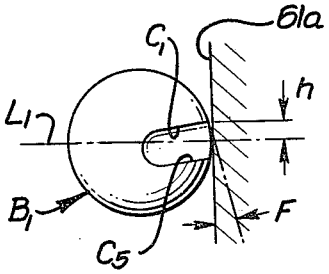
FIG. 8 is a bottom view of the model.
Figure 10:
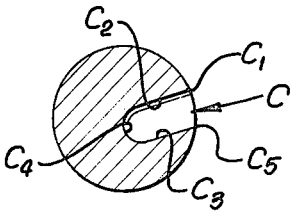
FIG. 10 is a sectional view taken on line X—X of FIG. 9.
Figure 9:
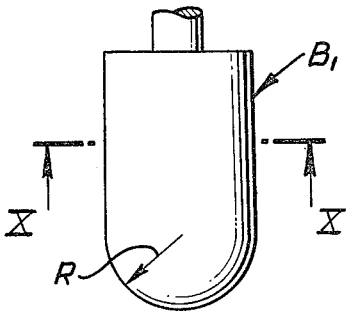
FIG. 9 is an elevational view thereof.
Figure 11:
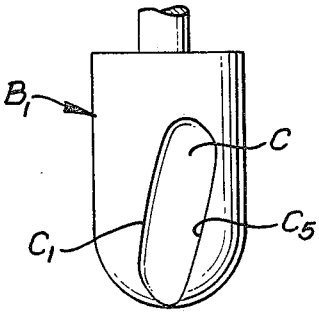
FIG. 11 is a side view thereof.
Figure 12:
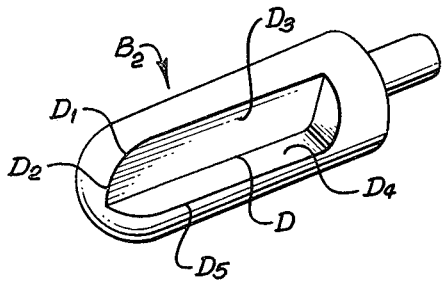
FIGS. 12 to 16, inclusive, are same views of the second embodiment of the model as FIGS. 7 to 11, respectively.
Figure 20:
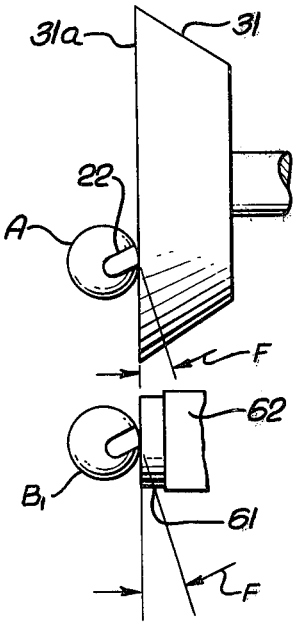
FIG. 20 is a right side view thereof.
Figure 19:
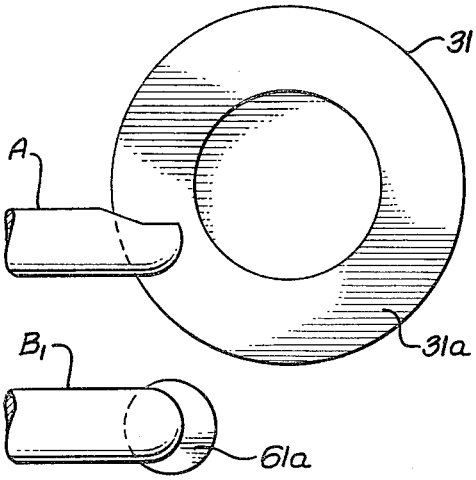
FIG. 19 is an elevational view thereof.

Then the cutter, which is pre-grinded to have the same surface of revolution as the model B1, is supported in the cutter support 40 with its rake face 22 facing upwards, as shown in FIG. 20, so that the required clearance angle is obtained. Also, the model B1 is supported in the model support 50 in the same relation as the cutter A, as shown in FIGS. 8, 20.

Figure 13:
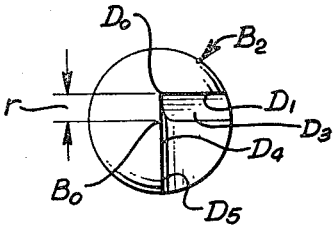
Figure 15:
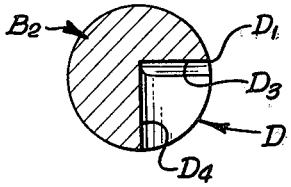
Figure 14:
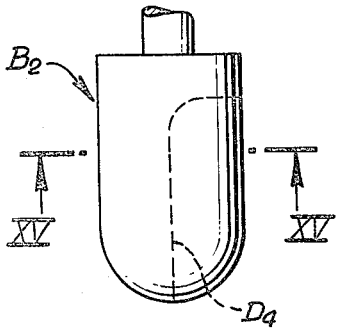
Figure 16:
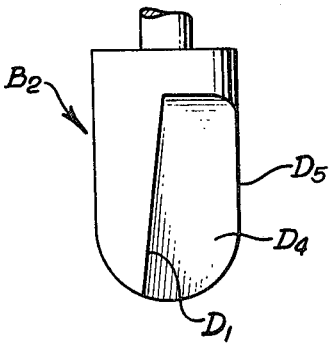

The groove of the model is not limited to the above and V-shape groove D which has two plane side wall D3, D4 and about 90 degree bottom therebetween, as shown in FIGS. 12 to 16 inclusive, is used. An angle of the groove bottom may be an acute angle or an obtuse angle. In a word, the required clearance angle must be obtained when the model line contacts with the guide face 61*a*. In this case, the model line D1 corresponding to the cutting edge of the cutter shows the straight line on the extension of the line of the cutter side cutting edge 28 observing from the bottom, as shown in FIG. 13. The other side wall D4 of the groove shows the plane passing through the model center of rotation BO. The beginning DO of the model line D1 displaces from the model center BO by radius of curvature r of cutting edge point.

Figure 17:
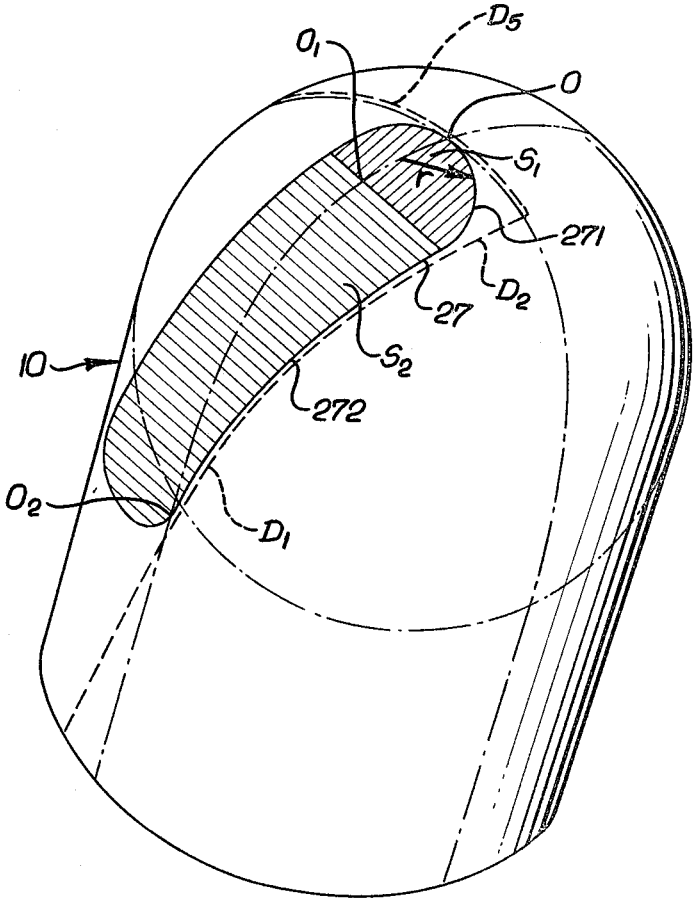
FIG. 17 is a descriptive view of a cutter point in perspective.

Here, the model point part corresponding to the cutting edge of the cutter point of radius r differs from the cutting edge of the cutter. However, by means of the model like this, the cutting edge of the cutter point is grinded in a smooth curve. Namely, the point of the cutter 10 is shown in three dimensions as shown in FIG. 17 for easy understanding. The intersection of the rake face and the flank lies in on the semi-spherical surface of the cylinder end whose diameter is same as the diameter of the end mill. The beginning 0 of the intersection lies in near the center of the semi-spherical point, and the end $O_2$ lies in the intersection line of the plane which intersects substantially perpendicularly with a tangent touching the cutting edge line at the beginning O and the outer periphery surface of the end mill cylinder. Therefore, the point part 271 of the cutting edge line having especially small radius of curvature is generated by grinding a part of sphere to remove with a substantial semi-circular plane S1. Therefore, when the model D touches with the guide 61 along the line D1, the point of the model (a part corresponding to the cutter point center O) touches with the guide 61 too, consequently the grinding plane corresponding to the plane S1 is generated, and the cutting edge is grinded in curve at the point. Also, the other part 272 of the cutting edge line is generated by the cutter turning in a horizontal and a vertical plane to describe the curved surface S2.

Figure 18:
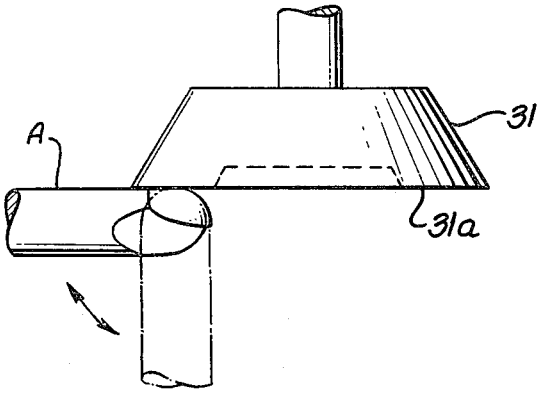
FIG. 18 is a plane view showing description of operation.

Next, the grinding operation of the apparatus will now be explained. The model line C1 of the side part of the model B1 is contacted with the guide face 61*a*, as shown in FIGS. 8, 18. At this time, the model line C1 lies in above by h from the straight line L1 which passes through the model center of rotation and is perpendicular to the guide face 61*a*. Thereby a desired clearance angle E is formed. In this state, a width or a figure of the groove C is determined so that the corner C5 formed at the outer end part of the side wall for the groove C does not contact or just contacts with the guiding face 61*a*.

From this state, the cutter A and the model B1 are turned solidly in about 90 degree, substantially with a center of the point of the cutter A, by operating shift part 70 so as to contact the model line C1 with the guide face 61*a* (shown as a dotted line). Thereby, the cutting edge of the cutter is grinded in imitation of the model line C1.

Here, as shown in FIG. 6, the width m of the grinding face 31*a* on the extension of the axis shaftline of the cutter support shell 41 is decided to be equal to the width n of guiding part of the guide face 61*a* just under the above grinding face. Consequently, the cutter is grinded in imitation of only the contact part of the model with the guide face, and certainly grinded without excess and deficiency against the model.

In case of grinding an end mill for the profiling milling machine, when a tracer stylus having a groove formed a model line is used as a model, this model can be obtained very easily and economically.

Also, the figure of the cutter (model) is not limited to the above, and the figure having spherical part on the point of a circular cone, or other figures are applicable.

This invention is described as above, so the flank of the cutter having difficult curve can be grinded very easily and accurately even by an unskilled person.

I claim:

1. A grinding apparatus for a flank of an end mill point comprising:

a grinding means having a grinding wheel which has a grinding face;

a model guide having a guide face flush with the grinding face of the grinding wheel and provided subjacent the grinding face of the grinding wheel;

a cutter support for supporting an end mill cutter horizontally in a support housing;

a model support for holding a model, said model support comprising a cylindrical arm hanging from the support housing of the cutter support at substantially the same height as the model guide such that an axial line of the model is located parallel with the axial line of the cutter and the model contacts with the model guide when the cutter contacts with the grind face of the grinding wheel;

a shift means for shifting the cutter support and the model support together toward the grinding wheel and for rotating the cutter and model support together through an angle substantially equal to 90° from a position substantially perpendicular to said grinding face to a position substantially parallel to said grinding face; and a model is provided in said model support in a same positional relationship as said and mill cutter, said model comprising a cylindrical body having a spherical point hving a same outer peripheral surface as a rotary contour outline of a cutter to be ground in the required position and a groove provided on an outer periphery surface such that a model line is formed corresponding to the required cutting edge of the cutter.

* * * * *